US007356281B2

(12) United States Patent
Miyakawa et al.

(10) Patent No.: US 7,356,281 B2
(45) Date of Patent: Apr. 8, 2008

(54) TONER, DEVELOPING DEVICE AND DEVELOPING METHOD USING THE SAME

(75) Inventors: Nobuhiro Miyakawa, Nagano (JP); Shinji Yasukawa, Nagano (JP); Hiroyuki Murakami, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 379 days.

(21) Appl. No.: 11/086,772

(22) Filed: Mar. 21, 2005

(65) Prior Publication Data

US 2005/0208404 A1 Sep. 22, 2005

(30) Foreign Application Priority Data

Mar. 22, 2004 (JP) ..... P.2004-081945

(51) Int. Cl.
*G03G 15/08* (2006.01)

(52) U.S. Cl. ..... 399/111; 399/119

(58) Field of Classification Search ..... 399/111, 399/119

See application file for complete search history.

(56) References Cited

U.S. PATENT DOCUMENTS 6,163,674 A * 12/2000 Ichikawa et al. ..... 399/284
6,524,762 B2 * 2/2003 Tsutsui et al. ..... 430/108.8
2002/0009305 A1 * 1/2002 Uehara ..... 399/55
2003/0113139 A1 * 6/2003 Yasukawa et al. ..... 399/281
2004/0248025 A1 * 12/2004 Miyakawa ..... 430/107.1

FOREIGN PATENT DOCUMENTS

| | | |
|---|---|---|
| EP | 1276017 | 1/2003 |
| EP | 1391787 | 2/2004 |
| JP | 63-289559 | 11/1988 |
| JP | 11-184144 | 7/1999 |
| JP | 2001-042614 | 2/2001 |
| JP | 2001-147547 | 5/2001 |
| JP | 2003-173081 | 6/2003 |
| JP | 2003-322998 | 11/2003 |

* cited by examiner

*Primary Examiner*—Hoa Van Le
(74) *Attorney, Agent, or Firm*—Hogan & Hartson LLP

(57) ABSTRACT

The present invention provides a toner having: a toner mother particle; a first external additive including a first inorganic fine particle having a primary particle size distribution of 200 to 750 nm and a work function approximately equivalent to that of the toner mother particle; a second external additive including a second inorganic fine particle having an mean particle size smaller than that of the first inorganic fine particle and a work function smaller than that of the toner particle, a stirring member of a developing device and/or an inner wall of the developing device; and 0.01% to 0.3% by weight of a metal soap having a work function approximately equivalent to that of the toner mother particle.

8 Claims, 6 Drawing Sheets

TONER, DEVELOPING DEVICE AND DEVELOPING METHOD USING THE SAME

FIELD OF THE INVENTION

The present invention relates to a toner which makes it possible to clean a used developing cartridge when the cartridge is recycled, a developing device and a developing method using the toner.

BACKGROUND OF THE INVENTION

In a background art, in some image forming apparatus, a photoreceptor drum or photoreceptor belt (hereinafter referred to as a photoreceptor) constituting an electrostatic latent image carrier is rotatably supported on a main body of the image forming apparatus, an electrostatic latent image is formed on a light-sensitive layer of the photoreceptor at the time of image formation operation, thereafter, the latent image is visualized with a developing agent of a developing device, and then, the visible image is transferred onto a recording material by using a corona transfer unit, transfer roller, transfer drum or transfer belt (hereinafter referred to as a transfer medium). Also, in some full-color image forming apparatus, a tandem apparatus, a system in which a plurality of color images are sequentially transferred onto the recording material such as a paper on the transfer belt or transfer drum, one over the other, using a plurality of photoreceptors or a plurality of developing mechanisms, and then fixed, is used. Further, in some image forming apparatus, an apparatus of a 4-cycle intermediate transfer system in which color images are sequentially primarily transferred onto an intermediate transfer medium to perform color superposition, and the primarily transferred images are secondarily transferred together to a transfer material, and an apparatus of a rotary developing system are used.

Further, a developing device having a primary reservoir, a secondary reservoir and a stirring member in order to use a developing agent in cycles is used. For example, in reference 1 and reference 2, a toner-circulating developing device in which a non-magnetic mono-component toner, a developing agent, is supplied to a developing member by a supply member through a regulating member to allow a thin layer of the toner to be kept on the developing member, wherein the toner which has not been fed onto the developing member through regulation by the regulating member is allowed to fall down, stirred together with the already existing toner in the primary reservoir, and then, transferred to the secondary reservoir.

Furthermore, for example, in references 3 to 6, plural kinds of external additives different in primary particle size are added to a toner in order to obtain stable print quality for a long period of time in continuous printing, and further, that an abrasive having a large particle size is added to prevent filming on a photoreceptor, an electrostatic latent image carrier.

[Reference 1] JP2001-42614 A
[Reference 2] JP2003-173081 A
[Reference 3] JP63-289559 A
[Reference 4] JP2001-147547 A
[Reference 5] JP11-184144 A
[Reference 6] JP2003-322998 A However, in the developing device as shown in reference 1 and reference 2, when a used developing cartridge is recycled to use, fine particles which are an external additive of a toner firmly adhere to a stirring member in the developing device, and it is almost impossible to remove the particles even when air is blasted for cleaning, which has caused the problem of taking a long time to clean the cartridge to reduce the production efficiency in a recycling process.

Further, also in the case of references 3 to 6, when an external additive is added to a toner in an amount of 2% by weight or more, the external additive is liberated from a surface of the toner, and the liberated external additive adheres to portions with which the toner is in contact in a developing cartridge, which has caused a factor contributing to taking a long time to clean the cartridge to reduce the production efficiency in recycling the used cartridge.

SUMMARY OF THE INVENTION

The invention is intended to solve the above-mentioned problems, and an object of the invention is to prevent a toner or an external additive from adhering to a stirring member and an inner wall of a developing device, thereby making it possible to easily perform cleaning in recycling a used developing cartridge. And other object of the invention is to provide a developing device and a developing method using the toner.

The present inventors have made eager investigation to examine the problem. As a result, it has been found that the foregoing objects can be achieved by the following toner and developing devise using the toner. With this finding, the present invention is accomplished.

The present invention is mainly directed to the following items:

(1) A toner comprising: a toner mother particle; a first external additive comprising a first inorganic fine particle having a primary particle size distribution of 200 to 750 nm and a work function approximately equivalent to that of the toner mother particle; a second external additive comprising a second inorganic fine particle having an mean particle size smaller than that of the first inorganic fine particle and a work function smaller than that of the toner particle, a stirring member of a developing device and/or an inner wall of the developing device; and 0.01% to 0.3% by weight of a metal soap having a work function approximately equivalent to that of the toner mother particle.

(2) The toner according to item 1, wherein each of the first and second inorganic fine particle is hydrophobilized, and the toner is a non-magnetic single-component negative-charged toner.

(3) The toner according to item 1, wherein the stirring member of the developing device and/or the inner wall of the developing device comprise a material having a work function equivalent to or higher than that of the toner mother particle.

(4) A developing device comprising the toner according to item 1.

(5) The developing device according to item 4, which further comprising a stirring member which allows the toner regulated by a regulating unit to stay in a primary reservoir and transfers the toner to the regulating unit through a secondary reservoir.

(6) The developing device according to item 4, wherein the stirring member of the developing device and/or the inner wall of the developing device comprise a material having a work function equivalent to or higher than that of the toner mother particle.

(7) The developing device according to item 4, wherein the stirring member comprises an elastic material.

(8) The developing device according to item 5, wherein the stirring member is rotated in a direction in which the toner regulated by the regulating unit is carried to the primary reservoir.

(9) A developing method comprising developing an image with the use of the toner according to item 1.

(10) The developing method according to item 9, wherein each of the first and second inorganic fine particle is hydrophobilized, and the toner is a non-magnetic single-component negative-charged toner.

(11) The developing method according to item 9, wherein the stirring member of the developing device and/or the inner wall of the developing device comprise a material having a work function equivalent to or higher than that of the toner mother particle.

According to the foregoing toner and developing devise, a first external additive, which comprises first inorganic fine particle having a mean particle size larger than that of a second inorganic fine particle set forth below and a work function approximately equivalent to that of a toner mother particle, do not generate electron (charge) transfer due to the difference between large and small work functions when kept as such. As a result, they can not electrostatically adhere (firmly adhere) to one another. When stirred for use in a developing device, the second external additive, which comprises second inorganic fine particle having a mean particle size smaller than that of the first inorganic fine particle and a work function smaller than the toner mother particle, a stirring member of a developing device and/or an inner wall of the developing device, adheres (firmly adhere) not only to the toner mother particle, but also to the first external additive. Accordingly, the first external additive is liberated or eliminated together with the second external additive from the surface of the toner mother particle. In particular, the second external additive adheres to a stirring member and an inner wall of the developing device having a work function approximately equivalent to or larger than that of the toner mother particle. In order to prevent liberation or elimination of the first external additive without inhibiting electrostatic characteristics of a toner, the toner in which a metal soap having a work function approximately equivalent to that of the toner mother particles is added and mixed together with other external additives is used as a developing agent. Thereby, it is able to prevent the external additive from adhering to the stirring member and the inner wall of the developing device. Further, the first external additive is not liberated from the toner, so that the toner itself can be prevented from adhering to the stirring member and the inner wall of the developing device by its abrasive effect and spacer effect, and easily removed even when it has adhered. Thus, contamination of the stirring member and the inner wall of the developing device caused by adhesion of the external additive or the toner can be prevented, and cleaning becomes easy. Accordingly, a recycling operation of a developing cartridge can be made easy.

In the present invention, the term "approximately" means that a difference between two values is not more than ±15% of any one of the two values.

In the present invention, the first external additive preferably has a primary particle size distribution of 200 to 750 nm. The metal soap is preferably contained in the toner in an amount of 0.01 to 0.3% by weight, more preferably 0.03 to 0.2% by weight, still more preferably 0.05 to 0.15% by weight based on the weight of the toner.

Also, Each of the inorganic fine particles of the first and second external additives is preferably hydrophobilized, and the toner is preferably a non-magnetic single-component negative-charged toner.

Furthermore, the stirring member of the developing device and/or the inner wall of the developing device comprise a material having a work function equivalent to or higher than that of the toner mother particle. The stirring member preferably comprises an elastic material. Furthermore, the stirring member is rotated in a direction in which the toner regulated by the regulating unit is carried to the primary reservoir. In the present invention, the elastic material is preferably a plastic.

DETAILED DESCRIPTION OF THE INVENTION

Embodiments of the invention will be described below.

Figure 1:
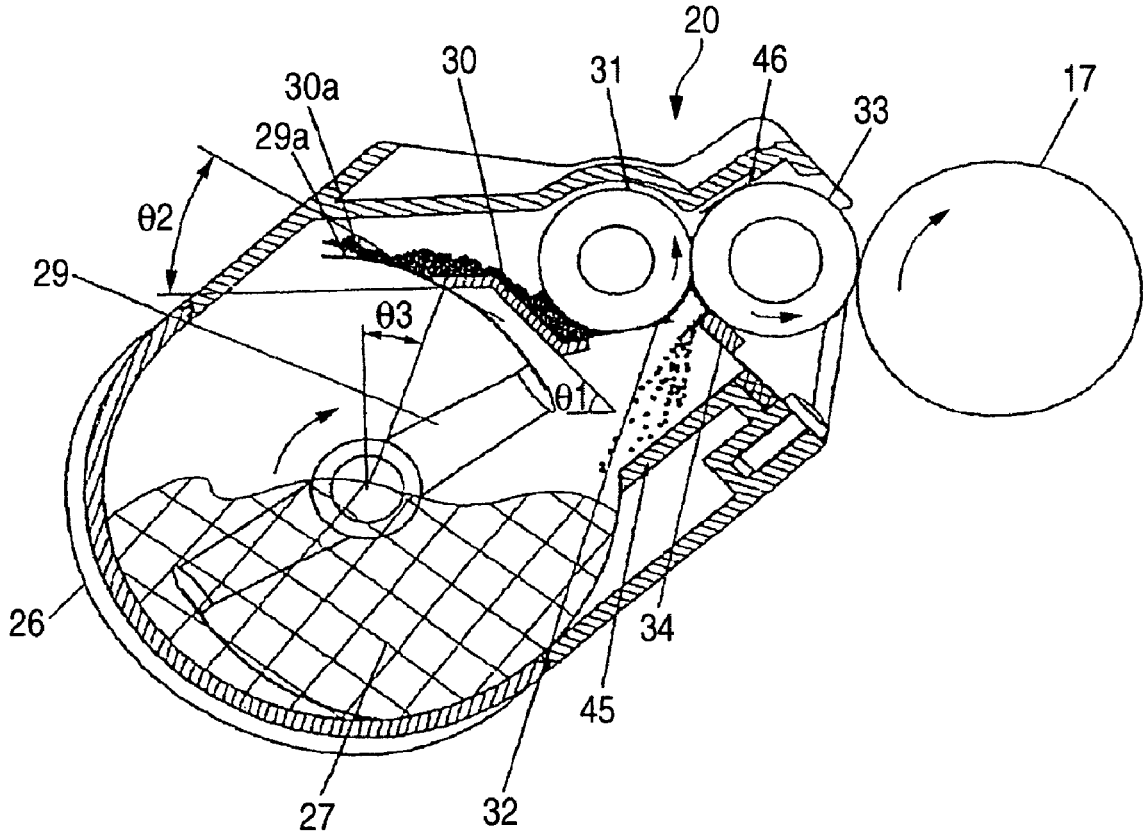
FIG. 1 is a view for illustrating an embodiment of a developing device to which the invention is applied.

FIG. 1 is a view for illustrating an example of a developing device to which the invention is applied.

A developing device main body 20 comprises a toner reserving vessel 26 for reserving a toner (a meshed portion in FIG. 1), a toner container (primary reservoir) 27 formed in the toner reserving vessel 26, a toner stirring member 29 disposed in the primary reservoir 27, a toner receiving member 30 mounted on an upper portion of the primary reservoir 27, a toner supply roller 31 disposed above the toner receiving member 30, a receiving sheet 32 attached to the toner receiving member 30 and brought into abutting contact with a lower portion of the toner supply roller 31, a developing roller 33 brought into abutting contact with the toner supply roller 31 and arranged so as to be opposed to a photoreceptor 17 with a slight clearance (about 100 to 300 μm), a regulating blade 34 brought into abutting contact with a lower portion of the developing roller 33, a casing wall 45 to which the regulating blade 34 is attached and which functions as a toner path member which a falling toner regulated by the regulating blade strikes, thereby allowing the toner to freely fall into the toner container, and an upper seal 46 for preventing toner leakage while being brought into abutting contact with the developing roller in a direction in which the toner remaining on the developing roller after development is recovered.

The developing roller 33 and the photoreceptor 17 are opposed to each other with a slight clearance, and driven for rotation in reverse directions to each other as indicated by arrows. In a developing region in which the developing roller and the photoreceptor are opposed to each other, respective peripheral surfaces move from below to above in the same direction, and a developing bias in which alternating voltage has been superimposed upon direct voltage is applied from a developing bias power source (not shown) to the developing roller. An oscillating electric field is allowed to act between the developing roller and the photoreceptor, and the toner is supplied from the developing roller to an electrostatic latent image portion formed on the photoreceptor to perform development. In this embodiment, the developing roller and the photoreceptor are arranged so as to be opposed to each other with a slight clearance. However, it is also possible that the developing roller and the photoreceptor may be brought into contact with each other in the developing region to perform development.

In the developing device of this embodiment, the primary reservoir 27 contains the toner to such a degree that the regulating blade 34 is not buried therein. The reasons for this are that when the toner is contained in such a large amount that the regulating blade 34 is buried, a circulating path through which the toner scraped with the regulating blade 34 is smoothly returned to the primary reservoir 27 is inhibited, and further, that the role of regulating the amount of excess toner scraped from the toner on the developing roller 33 with the regulating blade 34 and transferred to the developing region and the role of properly charging the toner are inhibited. Further, the primary reservoir 27 is rotatably equipped with stirring members 29 to leading edges of which flexible transfer members 29*c* composed of Mylar or the like are attached.

Figure 2A:
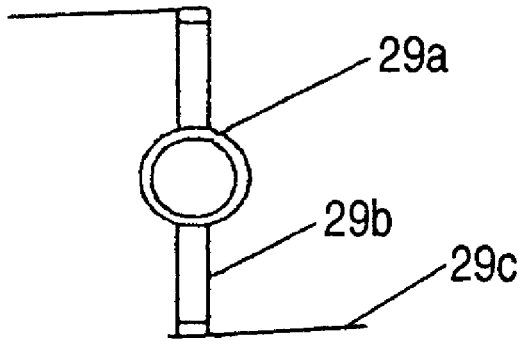
FIG. 2A and FIG. 2B are views for illustrating a stirring member.
Figure 2B:
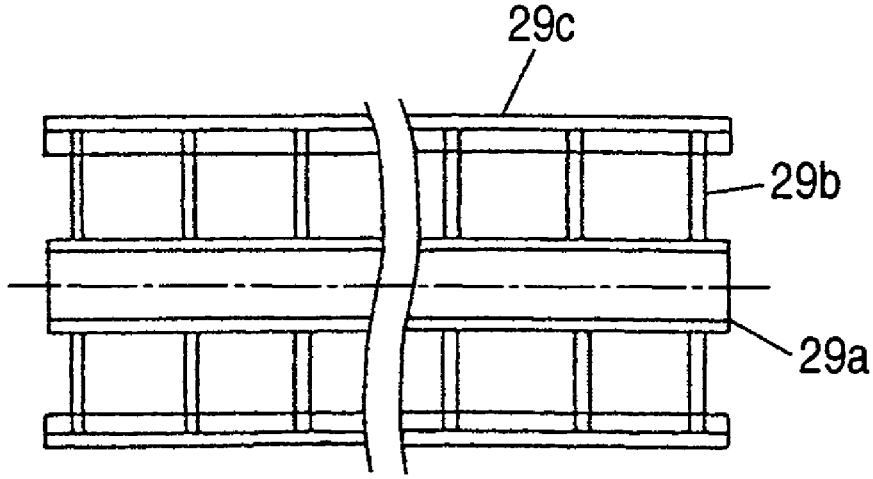

That is to say, as shown in FIGS. 2A and 2B, the stirring member 29 comprises a resin pipe 29*a* having a plurality of ribs at specified intervals and the flexible transfer members 29*c* composed of Mylar or the like, which are attached to the leading edges of the ribs. A number of slits are formed in the transfer members 29*c*. Then, the toner contained in the primary reservoir 27 with the transfer member 29*c* is supplied to a clearance (secondary reservoir) between the toner receiving member 30 and the supply roller 31 by rotating the stirring member 29.

Further, in the vicinity of the secondary reservoir, the supply roller 31 is disposed on which a conductive elastic layer having a plurality of cells on a periphery thereof is formed, and the elastic layer of the supply roller 31 is in press contact with the developing roller 33. The supply roller 31 and the developing roller 33 are driven for rotation in the same direction to allow respective peripheral surfaces to move in reverse directions in a contact region thereof, thereby performing frictional sliding on each other. Thus, voltage equivalent to developing bias voltage applied from a developing bias power source (not shown) to the developing roller is applied to the supply roller.

One end of the receiving sheet 32 formed into a plate shape is attached to the toner receiving member 30, and the receiving sheet 32 is brought into contact with a lower portion of the supply roller 31 at an appropriate line pressure. The presence of the receiving sheet prevents the toner adhered to the supply roller 31 from falling by gravity in a lower position thereof to inhibit a decrease in the amount of toner which can be supplied to the developing roller, thereby preventing a decrease in image density.

The toner supplied from the supply roller 31 to the developing roller 33 is regulated in the amount of toner transferred to the developing region by scraping excess toner from the developing roller with the regulating blade 34, and the toner is properly charged. Some of the excess toner scraped from the developing roller 33 with the regulating blade 34 falls down to the casing wall 45 under the regulating blade by gravity, and then, slides down on the wall, thereby being returned to the primary reservoir 27, and some directly falls down to be returned to the primary reservoir 27. In this case, the angle between the casing wall 45 and the horizontal line is set so as to become larger than the repose angle of the toner. Then, the toner regulated with the regulating plate and properly charged is transferred to the developing region opposing to the photoreceptor with the developing roller, and the electrostatic latent image portion on the photoreceptor is developed by the action of the oscillating electric field described above.

After the electrostatic latent image thus formed on the photoreceptor has been developed, the upper seal 46 is lightly brought into abutting contact with the developing roller 33 at a position where the toner remaining on the developing roller is returned to the developing device main body, thereby performing leakage prevention. After the development, the toner remaining on the developing roller 33 is eliminated from the surface of the developing roller by frictional sliding of the supply roller 31 and the developing roller whose peripheral surfaces move in reverse directions in the contact portion thereof, and mixed with the pooled toner in the clearance (secondary reservoir) between the toner receiving member 30 and the supply roller. The resulting toner is supplied as a fresh toner from the supply roller to the developing roller.

According to the above-mentioned constitution, when the toner scraped with the regulating blade 34 is recovered into the primary reservoir 27, recovery utilizing gravity and the repose angle of the toner removes stress imparted to the toner. As a result, fogging of the toner, a stained print white background caused by a decrease in charged amount and changes in density can be reduced, which makes it possible to maintain good image quality. Further, the amount of toner consumed is decreased, so that running costs can be reduced.

Furthermore, in the toner container, a center of the supply roller 31 is above an upper surface of a toner deposit, and a scraper 30*a* (a PET sheet having a thickness of about 0.15 mm) is attached to a leading edge of the toner receiving member 30 under the supply roller. The toner shown in black in FIG. 1 indicates a state in which the toner has been transferred onto the scraper 30*a*. The scraper 30*a* is set so that it is brought into abutting contact with the transfer member 29*c* attached to the leading edge of the stirring member 29, which enters from the leading edge side of the scraper, and pushed upward with the transfer member 29*c* to deform. Consequently, the toner transferred with the transfer member 29*c* is transferred to the scraper, and then, the scraper deforms upward to move the toner to the clearance (secondary reservoir) between the toner receiving member 30 and the supply roller 31. In the state in which the scraper 30*a* is attached to the toner receiving member, the angle between the scraper 30*a* and the horizontal line is desirably equal to or larger than the repose angle of the toner. However, even when the angle is smaller than the repose angle and the toner does not move and remains on the scraper, the transfer member 29*c* is brought into abutting contact with the scraper, and then, the scraper deforms upward, as described above. Accordingly, the angle becomes equal to or larger than the repose angle in this state, resulting in movement of the toner to the secondary reservoir.

The scraper 30*a* and the transfer member 29*c* are both formed of resin sheets, so that they have the property of being easily flexible by stress. As a suitable use, it is desirable that the scraper 30*a* has the property of being more flexible than the transfer member 29*c*. For that purpose, when the scraper and the transfer member are formed of the same material, the scraper is preferably thinned in its thickness, and when they are formed of different materials, the scraper is preferably set to be lower in rigidity. This causes the toner to be supplied to the secondary reservoir without delay by deformation of the scraper, after the toner has been sufficiently transferred from transfer member to the scraper.

On the other hand, when a tangent is drawn to the transfer member 29*c* at a point at which the transfer member 29*c* is first brought into abutting contact with the toner receiving member 30 in a cross section of a roller axis, the angle between this tangent and the horizontal line is taken as θ2, and the angle between the toner receiving member 30 and the horizontal line is taken as θ1. In this case, it is preferred that the relation of θ1>θ2 is satisfied. Granting that the relation of θ1<θ2 is satisfied, the angle of approach (90°−θ2) of the transfer member at the time when the transfer member and the scraper are brought into abutting contact with each other becomes large to inhibit smooth deformation of the scraper. Further, the problems are encountered that the overload is applied more than necessary to shorten the life of the transfer member, and that the torque necessary for rotating the stirring member to which the transfer member is fixed increases. Furthermore, it is also conceivable that loud noise is generated at the moment of abutting contact. Accordingly, it is preferred that the relation of θ1>θ2 is satisfied.

Further, the angle θ3 between a line which connects the point at which the transfer member 29*c* is first brought into abutting contact with the toner receiving member 30 and a rotation center of the stirring member 29 to which the transfer member is fixed and the vertical line preferably satisfies the relation of 0≦θ3, when the direction of rotation of the stirring member is taken as the positive direction. Granting that the angle θ3 is set so as to satisfy the relation of θ3<0, it is conceivable that the toner on the leading edge of the transfer member falls down from the transfer member or the scraper. Accordingly, the sufficient toner is not efficiently supplied to the secondary reservoir to cause deficiency of supply, resulting in a decrease in image density. From the above, the proper arrangement and rigidity of the transfer member and scraper achieve good supply of the toner.

Figure 3:
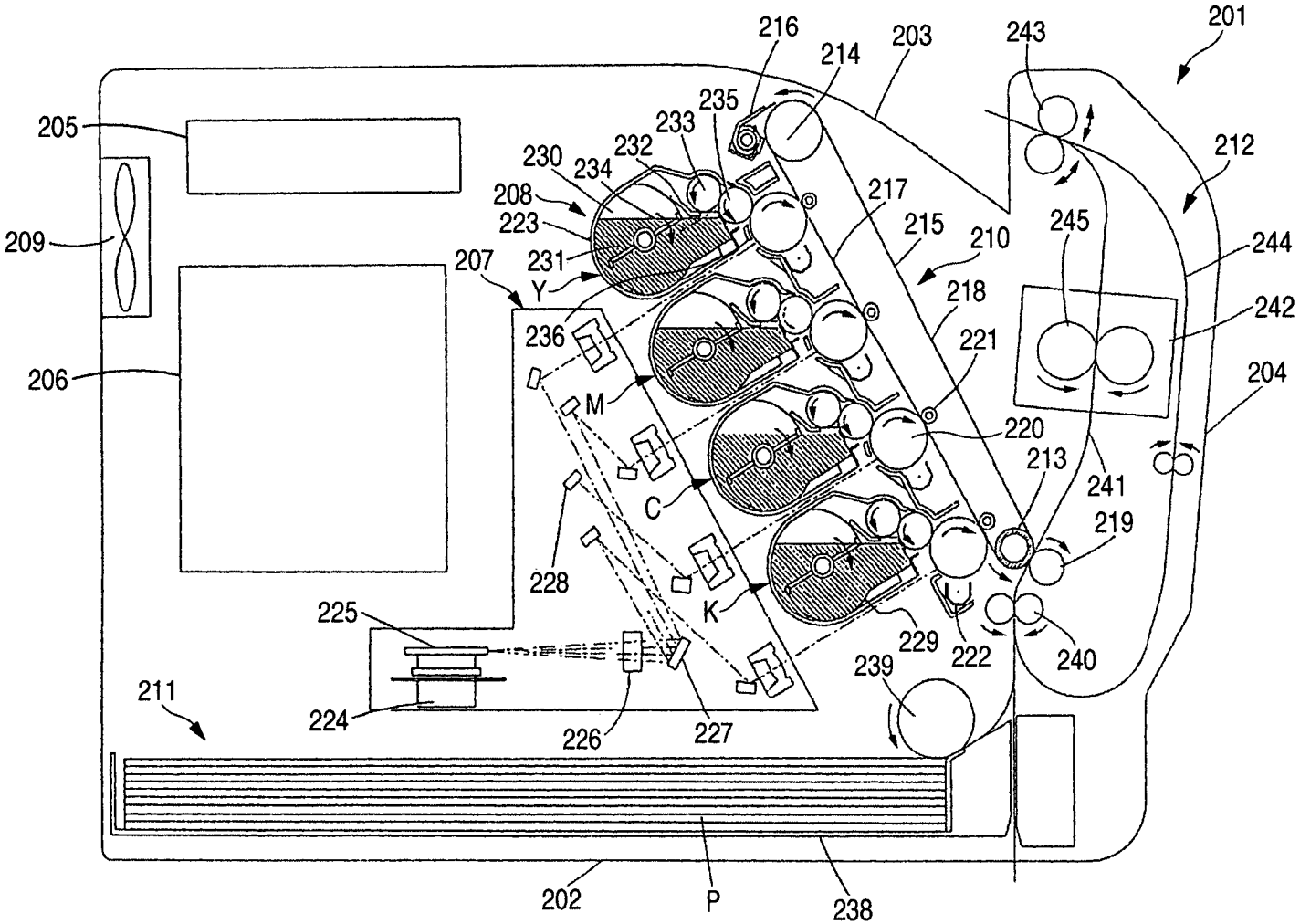
FIG. 3 is a view for illustrating an embodiment of a cleanerless color image forming apparatus on which the developing devices of FIG. 1 are mounted.

FIG. 3 is a view for illustrating an example of a cleanerless color image forming apparatus on which the developing devices of FIG. 1 are mounted.

The image forming apparatus 201 of this embodiment shown in FIG. 3, in which a photoreceptor is equipped with no cleaning means, comprises a housing 202, a delivery tray 203 formed on the top of the housing 202, and a door body 204 attached to the front of the housing 202 so as to freely open and close. In the housing 202, there are arranged a control unit 205, a power source unit 206, an exposure unit 207, an image forming unit 208, an exhaust fan 209, a transfer unit 210 and a paper feed unit 211. In the door body 204, a paper transfer unit 212 is disposed. The respective units are constituted so as to be detachable with respect to the main body, and integrally detachable for repair or replacement at the time of maintenance.

The transfer unit 210 comprises a driving roller 213 disposed in a lower portion of the housing 202 and driven for rotation by a driving source (not shown), a driven roller 214 disposed diagonally above the driving roller 213 and an intermediate transfer belt 215 spanned around only these two rollers and driven for circulation in a direction indicated by an arrow (the counter-clockwise direction). The driven roller 214 and the intermediate transfer belt 215 are arranged in a direction oblique to the left with respect to the driving roller 213 in FIG. 3. This allows a belt-tensioned side (a side at which the belt is stretched with the driving roller 213) 217 of the intermediate transfer belt 215 in driving to be positioned downward, and a belt-loosen side 218 upward. A cleaner 216 for scraping the toner which remains on the intermediate transfer belt without being transferred is disposed in a position opposite to the driven roller 213.

The driving roller 213 also serves as a backup roller for a secondary transfer roller 219 described later. A rubber layer having a thickness of about 3 mm and a volume resistivity of $1\times10^5$ Ω·cm or less is formed on a peripheral surface of the driving roller 213, and grounded through a metal shaft, thereby forming a conductive path of a secondary transfer bias supplied through the secondary transfer roller 219. As described above, the rubber layer having high friction and shock absorption is provided on the driving roller 213, whereby a shock at the time when a recording material enters a secondary transfer portion becomes difficult to be transmitted to the intermediate transfer belt 215. Thus, deterioration of image quality can be prevented.

Further, in the invention, the diameter of the driven roller 213 is smaller than that of the driven roller 214, whereby it can be made easy to separate a recording paper after secondary transfer by elastic force of the recording paper itself.

Furthermore, a primary transfer member 221 is brought into abutting contact with the back of the intermediate transfer roller 215, opposite to image carriers 220 of respective unicolor image forming units Y, M, C and K constituting an image forming unit described later, and a transfer bias is applied to the primary transfer member 221.

The image forming unit 208 comprises the unicolor image forming units Y (for yellow), M (for magenta), C (for cyan) and K (for black) for forming a plurality of images (four images in this embodiment) different in color. Each of the unicolor image forming units Y, M, C and K has the image carrier 220 comprising a photoreceptor on which an organic photosensitive layer or an inorganic photosensitive layer is formed, and a charging means 222 comprising a corona charger or a charging roller and a developing means 223, which are arranged around the image carrier 220.

The image carrier 220 of each of the unicolor image forming units Y, M, C and K is arranged so as to be brought into abutting contact with the belt-tensioned side 217 of the intermediate transfer belt 215. As a result, each of the unicolor image forming units Y, M, C and K is also arranged in a direction oblique to the left with respect to the driving roller 213 in FIG. 3. The image carrier 220 is driven for rotation in the reverse direction to the rotational direction of the intermediate transfer belt 215, as indicated by arrows in FIG. 3.

The exposure unit 207 is disposed obliquely below the image forming unit 208, and has a polygon mirror motor 224, a polygon mirror 225, an f-θ lens 226, a reflection mirror 227 and a turn-back mirror 228 in the inside thereof. Image signals corresponding to the respective colors are formed by modulation based on the common data lock frequency, and then, radiated from the polygon mirror 225. The image carriers 220 of the respective unicolor image forming units Y, M, C and K are irradiated with the image signals through the f-θ lens 226, the reflection mirror 227 and the turn-back mirror 228 to form latent images. The length of light paths to the image carriers 220 of the respective unicolor image forming units Y, M, C and K is substantially adjusted to the same length by the action of the turn-back mirror 228.

Then, the developing means 223 will be described, taking the unicolor image forming unit Y as an example. In this embodiment, the respective unicolor image forming units Y, M, C and K are arranged in a direction oblique to the left in FIG. 3, so that toner storage containers 229 are arranged obliquely downward.

That is to say, the developing means 223 comprises the toner storage container 229 for storing the toner, a toner storage portion 230 (a hatched portion in FIG. 3) formed in the toner storage container 229, a toner stirring member 231 disposed in the toner storage portion 230, a partition member 232 formed for partition in an upper portion of the toner storage portion 230, a toner supply roller 233 disposed above the partition member 232, a charging blade 234 attached to the partition member 232 and brought into abutting contact with the toner supply roller 233, a developing roller 235 arranged so as to come close to the toner supply roller 233 and the image carrier 220, and a regulating blade 236 brought into abutting contact with the developing roller 235.

The developing roller 235 and the toner supply roller 233 driven for rotation in the reverse direction to the rotational direction of the image carrier 220, as indicated by arrows in FIG. 3. On the other hand, the stirring member 231 is driven for rotation in the reverse direction to the rotational direction of the toner supply roller 233. The toner stirred and carried up with the stirring member 231 in the toner storage portion 230 is supplied to the toner supply roller 233 along an upper surface of the partition member 232. The toner supplied is frictionally slid on the charging blade 234 made of a flexible material to cause adhesive force to uneven portions of a surface of the toner supply roller 233 by mechanical adhesive force and frictional charging force, thereby being supplied to a surface of the developing roller 235.

The toner supplied to the developing roller 235 is regulated to a thin layer having a specified thickness. The toner layer thinned is transferred to the image carrier 220, and the latent image on the image carrier 220 is developed in the developing region in which the developing roller 235 and the image carrier 220 are close to each other.

Further, at the time of image formation, the paper supply unit 211 is provided with a paper supply cassette 238 in which plural sheets of a recording material P are superposed and held, and a pick-up roller 239 for feeding the recording material P from the paper supply cassette 238, sheet by sheet.

The paper transfer unit 212 comprises a pair of gate rollers 240 (one of which is mounted on the side of the housing 202) for defining the paper supply timing of the recording material P to the secondary transfer portion, the secondary transfer roller 219 as a secondary transfer means which is brought into press contact with the driving roller 213 and the intermediate transfer belt 215, a main recording material conveying path 241, a fixing means 242, a pair of delivery rollers 243 and a double-sided print conveying path 244. The fixing means has a pair of freely rotatable fixing rollers 245 at least one of which contains a heating element such as a halogen heater, and a pressing means for pressing at least one of the pair of fixing rollers 245 to the other, whereby a secondary image which has been secondarily transferred on the sheet material is pressed to the recording material P. The secondary image secondarily transferred to the recording material is fixed to the recording material at a nip portion formed by the pair of fixing rollers 245 at a specified temperature.

In the invention, the intermediate transfer belt 215 is arranged in a direction oblique to the left with respect to the driving roller 213 in FIG. 3, so that a wide space is generated on the right side. Accordingly, the fixing means 242 can be disposed in the space. It is therefore possible to realize miniaturization of the image forming apparatus and to prevent heat generated in the fixing means 242 from adversely affecting the exposure unit 207, the intermediate transfer belt 215 and the respective unicolor image forming units Y, M, C and K, which are positioned on the left side.

A measuring cell used for measurement of the work function of a toner will be illustrated below.

Figure 4A:
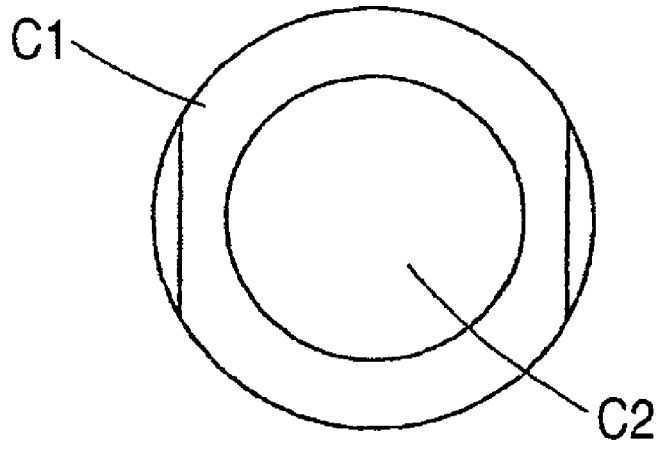
FIG. 4A and FIG. 4B are views for illustrating a sample measuring cell for measurement of the work function.
Figure 4B:
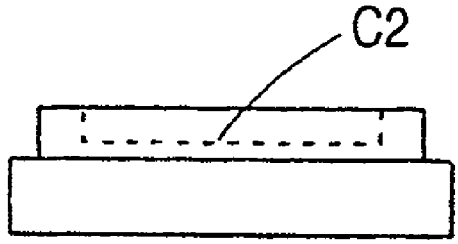

FIGS. 4A and 4B shows views for illustrating a sample measuring cell for measurement of the work function. As show in a plan view of FIG. 4A and a side view of FIG. 4B, the sample measuring cell C1 comprises a stainless steel disk having a diameter of 13 mm and a height of 5 mm, in which a toner receiving concavity C2 having a diameter of 10 mm and a depth of 1 mm is formed in the center thereof. The toner is put in the concavity of the cell by using a weighing spoon without compacting, and then, leveled with a knife edge. The measurement is made in this state.

The measuring cell filled with the toner is fixed onto a specified position of a sample stage, and then, the amount of irradiating light is set to 500 nW. Then, the measurement is made under the conditions of an irradiation area of 4 mm square and an energy scanning range of 4.2 to 6.2 eV.

Further, the normalized electron yield at the time when the work function of the toner is 8 or more at a measured amount of light of 500 nW.

Figure 5A:
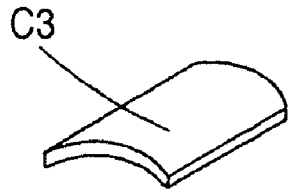
FIG. 5A and FIG. 5B are views for illustrating a method for measuring the work function of a sample having another shape.
Figure 5B:
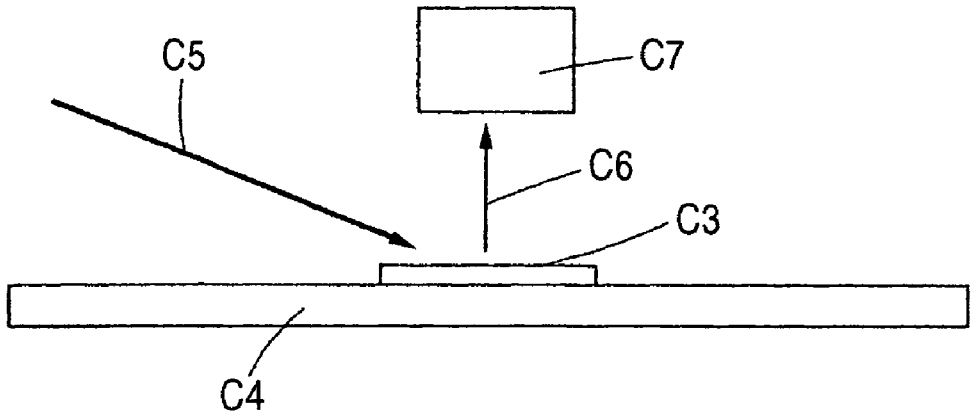

FIGS. 5A and 5B show views for illustrating a method for measuring the work function of a sample having another shape.

When a cylindrical member such as the intermediate transfer medium or the latent image carrier is used as the sample, the cylindrical member is cut to a width of 1 to 1.5 cm, and then, cut laterally along a edge line to obtain a measuring sample piece C3 having a shape as shown in FIG. 5A. Then, the sample piece is fixed onto a specified position of a sample stage C4 so that a surface to be irradiated is parallel to an irradiation direction of measuring light C5 as shown in FIG. 5B. This allows photoelectrons C6 emitted to be efficiently detected with a detector C7, that is to say, a photomultiplier.

EXAMPLES

The present invention is now illustrated in greater detail with reference to Examples and Comparative Examples, but it should be understood that the present invention is not to be construed as being limited thereto.

Preparation of Polymerization Toners

Preparation of Toner Mother Particles 1

A monomer mixture of 80 parts by weight of styrene monomer, 20 parts by weight of butyl acrylate and 5 parts be weight of acrylic acid was added to an aqueous solution mixture of 105 parts by weight of water, 1 part by weight of a nonionic emulsifier (Emulgen 950), 1.5 parts by weight of an anionic emulsifier (Neogen R) and 0.55 part by weight of potassium persulfate. The resulting mixture was stirred in a stream of nitrogen, and polymerized at 70° C. for 8 hours. After polymerization reaction, the reaction product was cooled to obtain a milky white resin emulsion having a particle size of 0.25 μm.

Then, 200 parts by weight of this resin emulsion, 20 parts by weight of a polyethylene wax emulsion (Permarin PN manufactured by Sanyo Chemical Industries, Ltd.) and 7 parts b weight of Phthalocyanine Blue were dispersed in water containing 0.2 part by weight of sodium dodecylbenzenesulfonate as a surfactant, and diethylamine was added to adjust the pH to 5.5. Then, 0.3 part by weight of aluminum sulfate as an electrolyte was added thereto with stirring, and subsequently stirred at high speed with an emulsion-dispersing apparatus, (TK Homomixer manufactured by Tokushu Kika Kogyo Co., Lid.) to perform dispersion.

Further, 40 parts by weight of a styrene monomer, 10 parts by weight of butyl acrylate and 5 parts by weight of zinc salicylate were added together with 40 parts by weight of water, and similarly heated in a stream of nitrogen at a temperature of 90° C. with stirring. Hydrogen peroxide was added, and polymerization was conducted for 5 hours to allow particles to grow. After termination of the polymerization, the temperature was elevated to 95° C. while adjusting the pH to 5 or more, and maintained for 5 hours, in order to improve the bonding strength of associated particles. Thereafter, the resulting particles were washed with water, and dried under vacuum at a temperature of 45° C. for 10 hours to obtain cyan toner mother particles 1. For cyan toner mother particles 1 thus obtained, measurements were made with an FPIA-2100 analyzer. The volume-based average particle size of the toner mother particles was 7.6 μm, the number-based average particle size was 6.8 μm, and the sphericity was 0.98. The work function of the cyan toner mother particles was measured with a commercially available surface analyzer (Type AC-2 manufactured by Riken Keiki Co., Ltd) at an amount of irradiating light of 500 nW. As a result, it was 5.57 eV.

Preparation of Toner Mother Particles 2

Toner mother particles 2 were prepared in the same manner as with toner mother particles 1 with the exceptions that quinacridone was used in place of Phthalocyanine Blue and that the temperature was maintained at 90° C. without being elevated to 95° C. in order to improve the association of secondary particles and the film-forming binding strength thereof. For magenta toner mother particles 2 thus obtained, measurements were made with an FPIA-2100 analyzer. The volume-based average particle size of the toner mother particles was 7.9 μm, the number-based average particle size was 7.0 μm, and the sphericity was 0.976. The work function of toner mother particles 2 was similarly measured. As a result, it was 5.64 eV.

Preparation of Toner Mother Particles 3 and 4

Yellow toner mother particles 3 and black toner mother particles 4 were each prepared in the same manner as with toner mother particles 1 with the exception that Pigment Yellow 180 and carbon black were each used in place of Phthalocyanine Blue. For yellow toner mother particles 3 thus obtained, measurements were made with an FPIA-2100 analyzer. The volume-based average particle size of the toner mother particles was 7.7 μm, the number-based average particle size was 6.9 μm, and the sphericity was 0.973. The work function of toner mother particles 3 was similarly measured. As a result, it was 5.59 eV.

Further, for black toner mother particles 4 thus obtained, measurements were made with an FPIA-2100 analyzer. The volume-based average particle size of the toner mother particles was 7.8 μm, the number-based average particle size was 7.0 μm, and the sphericity was 0.974. The work function of toner mother particles 4 was similarly measured. As a result, it was 5.52 eV.

Preparation of Solution Suspension Toner

Preparation of Toner Mother Particles 5

A hundred parts by weight of a 50:50 (by weight) mixture (Himer ES-803 manufactured by Sanyo Chemical Industries, Ltd.) of a polycondensation polyester of an aromatic dicarboxylic acid and alkylene etherified bisphenol A and a partially crosslinked compound of the polycondensation polyester with a polyvalent metal compound, 5 parts by weight of Pigment Blue 15:1 as a cyan pigment, 3 parts by weight of carnauba wax having a melting point of 80 to 86° C. as a release agent and 4 parts by weight of a metal complex compound of salicylic acid (E-81 manufactured by Orient Chemical Industries, Ltd.) as a charge control agent were uniformly mixed by using a Henschel mixer, and then kneaded by using a double-screw extruder having an inner temperature of 130° C., followed by cooling.

Then, the cooled matter was roughly pulverized to pieces of 2 mm square or less, and 100 parts by weight of this crudely pulverized matter was stirred in a mixed organic solvent solution of 150 parts by weight of toluene and 100 parts by weight of ethyl acetate to prepare a uniformly mixed oil-phase dispersion solution.

Then, 5 parts by weight of a fine powder of tricalcium phosphate (previously pulverized in a ball mill, and confirmed to contain no particles having a particle size of 3 μm or more) and 5 parts by weight of a 1% by weight aqueous solution of sodium dodecylbenzenesulfonate were added to 1100 parts by weight of ion exchanged water, followed by stirring to prepare a uniformly mixed aqueous-phase dispersion solution.

Figure 6:
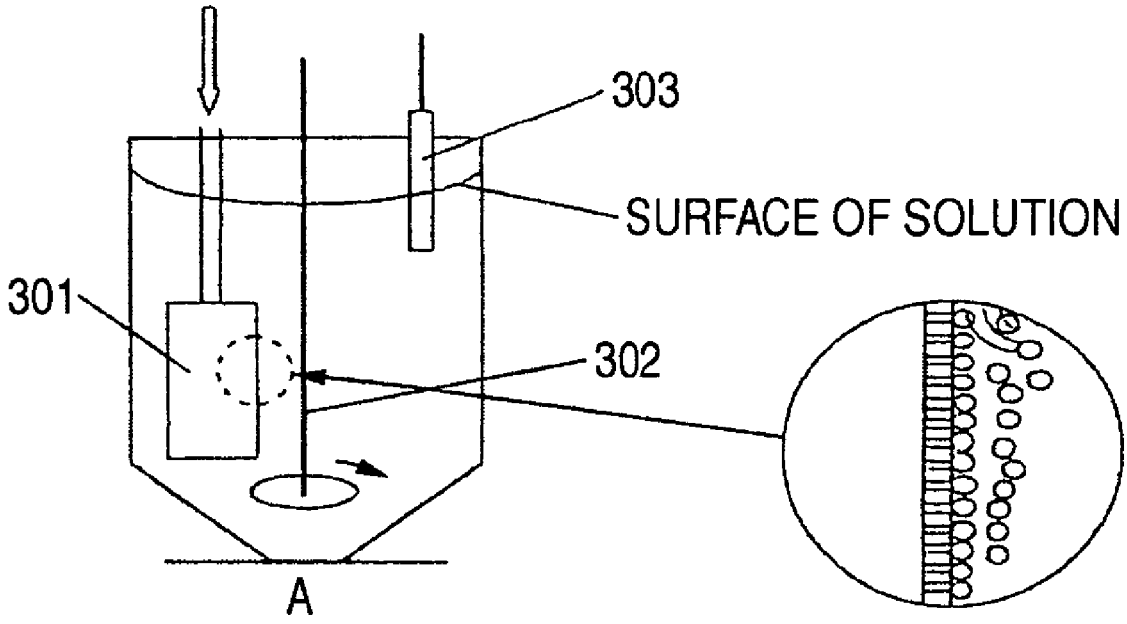
FIG. 6 is a view for illustrating a granulation method.

In granulation, the above-mentioned aqueous-phase dispersion solution was first transmitted to a vessel equipped with a blowout unit of porous glass 301 (having a pore size of 3 μm), a stirring blade 302 and an ultrasonic element 303 as shown in FIG. 6, and stirred. Then, stirring was continued while forcing the above-mentioned oil-phase dispersion solution into a pipe directly connected to the blowout unit comprising the porous glass 301 in the vessel (from an upper portion of the vessel indicated by an open arrow in FIG. 6). Particles ejected from pores of the porous glass 301 were segmented with ultrasonic waves, thereby forming an emulsion. The stirring blade 302 was rotated so that the fine emulsion particles formed do not coalesce. Stirring was continued in a rotational direction indicated by a solid arrow in FIG. 6 for 10 minutes after termination of forcing the dispersion solution into the pipe.

Then, the emulsion thus formed was taken out from a bottom A of the vessel, and transmitted to a stirring tank separately prepared. After transmitted to the stirring tank, the emulsion was kept at a temperature of 50° C. or more in the stirring tank with stirring to remove the organic solvents contained. Then, the emulsion was repeatedly washed with 5 N hydrochloric acid, washed with water and filtered, and dried to obtain cyan toner mother particles 5 having a number average particle size of 6.7 μm. For cyan toner mother particles 5 thus obtained, measurements were made with an FPIA-2100 analyzer. The volume-based average particle size of the toner mother particles was 7.5 μm, the number-based average particle size was 6.8 μm, and the sphericity was 0.98. The work function of the resulting toner mother particles was measured with a commercially available surface analyzer (Type AC-2 manufactured by Riken Keiki Co., Ltd) at an amount of irradiating light of 500 nW. As a result, it was 5.23 eV.

Preparation of Toner Mother Particles 6, 7 and 8 Toner Mother particles 6, 7 and 8 were each prepared in the same manner as with tone mother particles 5 with the exception that Carmine 6B as a magenta pigment, Pigment Yellow 180 as a yellow pigment and carbon black as a black pigment were each used in place of the cyan pigment. For the toner mother particles of the respective colors, the average particle size, the sphericity and the work function were measured. The results thereof are shown in Table 1.

TABLE 1

| Toner Mother Particles | Volume-Based Average Particle Size (μm) | Number-Based Average Particle Size (μm) | Number-Based Sphericity | Work Function (eV) |
|---|---|---|---|---|
| Magenta Toner Mother Particles 6 | 7.3 | 6.6 | 0.980 | 5.70 |
| Yellow Toner Mother Particles 7 | 7.2 | 6.5 | 0.981 | 5.51 |
| Black Toner Mother Particles 8 | 7.2 | 6.6 | 0.980 | 5.40 |

In the results of Table 1, it is shown that even the prepared toners each having a different color are alike in average particle size and the sphericity.

Production Example of Organic Photoreceptor

A coating solution was prepared by dissolving and dispersing 6 parts by weight of alcohol-soluble nylon (CM8000 manufactured by Toray Industries, Inc.) and 4 parts by weight of fine titanium oxide particles treated with an aminosilane in 100 parts by weight of methanol. This coating solution was applied by a ring coating method onto an aluminum pipe 30 mm in diameter which was used as a conductive support, and dried at a temperature of 100° C. for 40 minutes, thereby forming an undercoat layer having a thickness of 1.5 to 2 μm.

A dispersion solution was prepared by dispersing 1 part by weight of oxytitanium phthalocyanine as a charge generating pigment and 1 part by weight of a butyral resin (BX-1 manufactured by Sekisui Chemical Co., Ltd.) in 100 parts by weight of dichloroethane for 8 hours in a sand mill having glass beads 1 mm in diameter. The resulting dispersion solution was applied onto the undercoat layer of the above-mentioned support by the ring coating method, and dried at a temperature of 80° C. for 20 minutes, thereby forming a charge generation layer having a thickness of 0.3 μm.

A coating solution was prepared by dissolving 40 parts by weight of a charge transfer material of a styryl compound having the following structural formula (1) and 60 parts by weight of a polycarbonate resin (Panlite TS manufactured by Teijin Chemicals Ltd.) in 400 parts by weight of toluene. The resulting solution was applied onto the charge generation layer by a dip coating method so as to give a dry thickness of 22 μm, and dried to form a charge transport layer, thereby preparing organic photoreceptor (OPC1) having a photosensitive layer comprising two layers.

A part of the resulting organic photoreceptor was cut to prepare a test piece, and the work function thereof was measured with a commercially available surface analyzer (Type AC-2 manufactured by Riken Keiki Co., Ltd) at an amount of irradiating light of 500 nW. As a result, it showed 5.47 eV.

(1)

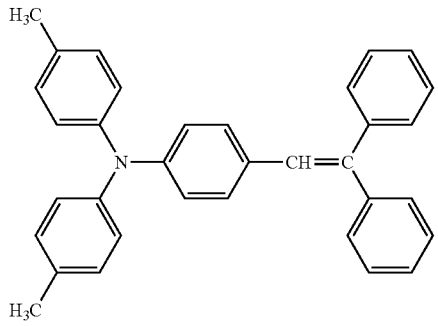

Preparation of Developing Roller

A surface of an aluminum pipe 18 mm in diameter was nickel-plated (to a thickness of 10 μm) to obtain a developing roller having a surface roughness (Rz) of 4 μm. The work function of the surface of this developing roller was measured. As a result it was 4.58 eV.

Preparation of Regulating Blade

A conductive polyurethane tip 1.5 mm in thickness was adhered to a stainless steel (SUS) plate 80 μm in thickness with a conductive adhesive, thereby preparing a regulating blade. The work function of the polyurethane portion was 5 eV.

Production Example of Intermediate Transfer Belt

A mixture obtained by preliminarily mixing 85 parts by weight of polybutylene terephthalate, 15 parts by weight of a polycarbonate, and 15 parts by weight of acetylene black by a mixer under a nitrogen gas atmosphere was subsequently kneaded by a double-screw extruder under a nitrogen gas atmosphere to obtain pellets. The pellets were extruded into a tubular film having an outer diameter of 170 mm and a thickness of 160 μm by a single-screw extruder having an annular die at a temperature of 260° C. Then, the extruded melt tube was defined in inner diameter with a cooling inside mandrel supported on the same axis as the annular die, and solidified by cooling to prepare a seamless tube. The seamless tube was cut to specified dimensions to obtain a seamless belt having an outer diameter of 172 mm, a width of 342 mm and a thickness 150 μm. This transfer belt had a volume resistivity of $3.2\times10^3$ Ω·cm, and showed a work function of 5.19 eV and a normalized photoelectron yield of 10.88.

Preparation Example of Cleaning Blade

A cleaning unit for the intermediate transfer body of the invention was prepared by first preparing a cleaning blade by the following method, and then, adhering it to a metal support plate for fitting with a hot melt adhesive.

The blade comprised a urethane rubber having a hardness of 67°±3°, the thickness thereof was 2 mm, the projection amount was 8 mm, press contact was performed by a counter system, the press contact angle was 20°, the line pressure at the time of operation was 23.15 N·m, and loading was performed by a spring pressure system.

A polyesterdiol obtained by dehydration condensation of a diol of the poly(ε-caprolactone) family and adipic acid, 4'-diphenylmethane diisocyanate, 1,4-butanediol and trimethylolpropane were mixed, cast in a mold previously heated, and cured by heating to prepare and mold a urethane rubber. After molding, the molded article was cut to adjust the width, thickness and length, thereby preparing a cleaning blade. The work function of the cleaning blade thus prepared was measured with a commercially available surface analyzer (Type AC-2 manufactured by Riken Keiki Co., Ltd) at an amount of irradiating light of 500 nW. As a result, it was 5.03 eV.

First, the work functions of the external additives used are shown in Table 2. As the respective external additives, hydrophobilized ones were used.

TABLE 2

| External Additive | Work Function (eV) | External Additive (Abbreviation) | Work Function (eV) |
|---|---|---|---|
| Negatively Chargeable Vapor Phase Method Silica (12 nm) | 5.22 | Fine Calcium Stearate Particles (M1StCa) | 5.32 |
| Negatively Chargeable Vapor Phase Method Silica (40 nm) | 5.24 | Zinc Stearate (M2StZn) | 5.64 |
| Titanium Oxide (20 nm) | 5.64 | Magnesium Stearate (M3StMg) | 5.57 |
| Titanium Oxide (200 to 750 nm) | 5.41 | Calcium Stearate (M4StCa) | 5.49 |
| Strontium Titanate (250 to 700 nm) | 5.48 | Fine Zinc Stearate Particles (M5StZn) | 5.36 |
| Monodisperse Spherical Silica (300 nm) | 5.01 | Fine Magnesium Stearate Particles (M6StMg) | 5.58 |

The work function of each external additive was measured at an amount of irradiating light of 500 nW with a commercially available surface analyzer, Type AC-2, manufactured by Riken Keiki Co., Ltd.

Experimental Example 1

Metal soaps combined with toner mother particles 1, 2, 3 and 4 described above are shown in Table 3, and a formulation of the external additive added to the toner mother particles was as follows.

A toner was prepared in which 0.8% by weight of hydrophobic silica having an average primary particle size of about 12 nm, 0.7% by weight of hydrophobic silica having an average primary particle size of about 40 nm, 0.4% by weight of hydrophobilized monodisperse spherical silica, 0.5% by weight of hydrophobic titanium oxide having a particle size of about 20 nm, 0.5% by weight of negatively chargeable titanium oxide having an average primary particle size within the particle size distribution range of 200 to 750 nm and 0.2% by weight of the metal soap shown in Table 3 were added to the toner mother particles.

TABLE 3

| Toner Mother Particles/Work Function | Metal Soap/Work Function |
|---|---|
| Cyan toner 1/5.57 eV | M3StMg/5.57 eV |
| Magenta toner 2/5.64 eV | M2StZn/5.64 eV |
| Yellow toner 3/5.59 eV | M6StMg/5.58 eV |
| Black toner 4/5.52 eV | M4StCa/5.49 eV |

As toners for comparison, toners free from negatively chargeable titanium oxide having an average primary particle size within the particle size distribution range of 200 to 750 nm and the metal soap were prepared for respective colors.

Corresponding developing cartridges of a photoreceptor cleanerless type tandem color printer equipped with the above-mentioned organic photoreceptor, developing rollers, regulating blades, intermediate transfer belt and cleaning blade were filled with the toners, respectively, and continuous printing tests were conducted.

Development was performed by a non-contact developing system in the order of increasing work function of the toners, from an upstream side of a direction in which the intermediate transfer belt advanced, that is to say, in the order of the magenta toner, the yellow toner, the cyan toner and the black toner. However, printing was made possible even when the black toner was used first or last. In changing the order of development, the order of image treatment was changed.

The developing gap was set to 200 μm, and the developing bias was set so that the developing toner amount per color on the organic photoreceptor was inhibited up to 0.55 $mg/cm^2$ by patch control. The frequency of alternating current superimposed on direct current was 2.5 kHz, and the peak-to-peak voltage was 1400 V. The amount of the regulated toner on the developing roller was adjusted so as to be 0.4 $mg/cm^2$. The power source of the primary transfer portion was constant voltage controlled, and +500 V was applied. The power source of the secondary transfer portion was constant current controlled.

Then, a character image corresponding to a 5% color image per color (including a character image and a color line image) was continuously printed on 10,000 sheets of paper. After termination of the printing, each residual toner was discharged from an opening for filling, and a state in which the toner adhered to the used developing device and stirring member of each color toner was examined. The results thereof are shown together with materials for the developing containers and stirring members (sheet thickness: 100 μm) in Table 4.

TABLE 4

| Material for Developing Container/ Work Function of Material | Stained State | | Material for Stirring Member/Work Function of Material | Stained State | |
|---|---|---|---|---|---|
| | Toner of the Invention | Toner for Comparison | | Toner of the Invention | Toner for Comparison |
| Polystyrene-based/ 5.19 | Some stains remain even when air is blown. | A wiping operation is necessary after air blowing. | Vinyl chloride-based/ 4.99 | Some stains remain even when air is blown. | A wiping operation is necessary after air blowing. |
| ABS-Based/ 5.62 | Stains are removed by air blowing. | A wiping operation is necessary after air blowing. | Mylar/ 5.74 | Stains are removed by air blowing. | A wiping operation is necessary after air blowing. |

According to the results, the use of the member having a small work function necessitated the wiping operation after air blowing in the developing container and the stirring member. However, when the toner of the invention was used, cleaning was sufficiently performed only by air blowing. In order to examine the stained state of the stirring member, a part of a vinyl chloride-based sheet blade was cut out, and the work function of a surface thereof was measured with respect to the case of cyan toner 1 for comparison.

As for the stained state, not only the cyan toner adhered to a part of the blade, but also the whole blade was whitened. At the same time, the case that magenta toner 2 of the invention was used and cleaning was performed by air blowing was also examined. As a result, it was revealed that when the toner and material of the invention were used, cleaning was sufficiently performed only by air blowing.

The work function of the blade to which a white material fixedly adhered showed 5.22 eV. The reason for this is considered to be that a silica component in the external additive adhered to the blade. However, in the case of the toner in which the external additive contained amorphous titanium oxide having a particle size distribution of 200 nm to 750 nm and the metal soap, it was indicated that stains on an inner wall of the developing container and the blade which is the stirring member could be cleaned only by air blowing, which made it possible to recycle the developing device without taking time, thereby increasing the recycle production efficiency. The reason for this is considered to be that not only the external additive was hard to be liberated from surfaces of the toner mother particles, but also the grinding effect of the inorganic external additive was also expressed at the same time.

Experimental Example 2

Metal soaps combined with toner mother particles 5, 6, 7 and 8 described above are shown in Table 5, and a formulation of the external additive added to the toner mother particles was as follows.

Each toner was prepared in which 0.8% by weight of hydrophobic silica having an average primary particle size of about 12 nm, 0.1% by weight of hydrophobic silica having an average primary particle size of about 40 nm, 0.4% by weight of hydrophobilized monodisperse spherical silica, 0.5% by weight of hydrophobic titanium oxide having a particle size of about 20 nm, 0.2% by weight of negatively chargeable strontium titanate having an average primary particle size within the particle size distribution range of 250 to 700 nm and 0.1% or 0.35% by weight of the metal soap shown in Table 5 were added to the toner mother particles.

As toners for comparison, toners free from negatively chargeable strontium titanate having an average primary particle size within the particle size distribution range of 200 to 750 nm and the metal soap were prepared for respective colors.

TABLE 5

| Toner Mother Particles/Work Function | Metal Soap/Work Function |
|---|---|
| Cyan toner 5/5.23 eV | M1StCa/5.32 eV |
| Magenta toner 6/5.70 eV | M2StZn/5.64 eV |
| Yellow toner 7/5.51 eV | M4StCa/5.49 eV |
| Black toner 8/5.40 eV | M5StZn/5.36 eV |

Corresponding developing cartridges of the tandem color printer were filled with the toners prepared, respectively, in the same manner as with Experimental Example 1, and continuous printing tests were conducted. Development was performed by a non-contact developing system in the order of increasing work function of the toners, from an upstream side of a direction in which the intermediate transfer belt advanced, that is to say, in the order of the magenta toner, the yellow toner and the cyan toner. The black toner was set to be used first as the order of development.

After termination of the printing, each residual toner was discharged from an opening for filling, and a state in which the toner adhered to the used developing device and stirring member of each color toner was examined. The results thereof are shown together with materials for the developing containers and stirring members (sheet thickness: 100 μm) in Table 6.

TABLE 6

| Material for Developing Container/ | Stained State | | Material for Stirring | Stained State | |
|---|---|---|---|---|---|
| Work Function of Material | Toner of the Invention | Toner for Comparison | Member/Work Function of Material | Toner of the Invention | Toner for Comparison |
| Polystyrene-based/5.19 | Some stains remain even when air is blown. | A wiping operation is necessary after air blowing. | Vinyl chloride-based/4.99 | Some stains remain even when air is blown. | A wiping operation is necessary after air blowing. |
| ABS-Based/5.62 | Stains are removed by air blowing. | A wiping operation is necessary after air blowing. | Mylar/5.74 | Stains are removed by air blowing. | A wiping operation is necessary after air blowing. |

According to the results, the use of the member having a small work function necessitated the wiping operation after air blowing in the developing container and the stirring member. However, when the toner of the invention was used, cleaning was sufficiently performed only by air blowing. Further, filming of each color toner on the organic photoreceptor after the continuous printing was examined. As a result, when the content of the metal soap was 0.1%, the amount of filming was within the range of 0.005 to 0.007 mg/cm$^2$ for each color toner. However, when the content of the metal soap was 0.35%, the amount of filming tended to increase slightly, and the amount thereof was within the range of 0.008 to 0.009 mg/cm$^2$. The grinding effect of the large-sized fine inorganic external additive tended to be reduced. Accordingly, it can be decided that the upper limit of the content of the metal soap is preferably 0.3% or less.

According to the invention, the toner or the external additive is prevented from adhering to the stirring member and the inner wall of the developing device, thereby making it possible to easily perform cleaning in recycling the used developing cartridge. Accordingly, the industrial utility value thereof is extremely large.

While the present invention has been described in detail and with reference to specific embodiments thereof, it will be apparent to one skilled in the art that various changes and modifications can be made therein without departing the spirit and scope thereof.

The present application is based on Japanese Patent Application No. 2004-81945 filed on Mar. 22, 2004, and the contents thereof are incorporated herein by reference.

What is claimed is:

1. A toner container containing toner, and provided with a stirring member operable to stir the toner in the container, and adapted to be used with a developing device to develop an electrostatic latent image formed on an image carrier, the toner comprising:

a toner mother particle;

a first external additive comprising a first inorganic fine particle having a primary particle size distribution of 200 to 750 nm and a work function approximately equivalent to that of the toner mother particle;

a second external additive comprising a second inorganic fine particle having a mean particle size smaller than that of the first inorganic fine particle and a work function smaller than those of the toner particle, and at least one of the stirring member and an inner wall of the container; and 0.01% to 0.3% by weight of a metal soap having a work function approximately equivalent to that of the toner mother particle.

2. The toner container according to claim 1, wherein each of the first and second in organic fine particle is hydrophobilized, and the toner is a non-magnetic single-component negative-charged toner.

3. The toner container according to claim 1, wherein at least one of the stirring member and the inner wall of the toner container comprises a material having a work function equivalent to or higher than that of the toner mother particle.

4. A developing device comprising the toner container according to claim 1.

5. The developing device according to claim 4, which further comprising a stirring member which allows the toner regulated by a regulating unit to stay in a primary reservoir and transfers the toner to the regulating unit through a secondary reservoir.

6. The developing device according to claim 4, wherein the stirring member of the developing device and/or the inner wall of the developing device comprise a material having a work function equivalent to or higher than that of the toner mother particle.

7. The developing device according to claim 4, wherein the stirring member comprises an elastic material.

8. The developing device according to claim 5, wherein the stirring member is rotated in a direction in which the toner regulated by the regulating unit is carried to the primary reservoir.

* * * * *